US007882665B2

(12) United States Patent
Kawai et al.

(10) Patent No.: US 7,882,665 B2
(45) Date of Patent: Feb. 8, 2011

(54) CONSTRUCTION CONFIGURATIONS AND CONSTRUCTION METHODS OF STEEL HOUSES

(75) Inventors: Yoshimichi Kawai, Tokyo (JP); Kazunori Fujihashi, Tokyo (JP); Shigeaki Tohnai, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 744 days.

(21) Appl. No.: 10/565,431

(22) PCT Filed: Jul. 21, 2005

(86) PCT No.: PCT/JP2005/013779

§ 371 (c)(1),
(2), (4) Date: Jan. 19, 2006

(87) PCT Pub. No.: WO2006/057096

PCT Pub. Date: Jun. 1, 2006

(65) Prior Publication Data

US 2008/0047225 A1 Feb. 28, 2008

(30) Foreign Application Priority Data

Nov. 25, 2004 (JP) ..... 2004-340460

(51) Int. Cl.
*E04H 1/02* (2006.01)
*E04B 5/02* (2006.01)
*E04C 3/02* (2006.01)

(52) U.S. Cl. ..... 52/236.6; 52/261; 52/236.3; 52/262; 52/204.2

(58) Field of Classification Search ..... 5/261, 5/266, 284, 653.1, 79.9, 236.3, 236.6, 262, 5/264; 52/261, 266, 284, 653.1, 79.9, 236.3, 52/236.6, 262, 264, 236.7, 236.9, 289, 702, 52/236.4, 204.1, 204.2
See application file for complete search history.

(56) References Cited

U.S. PATENT DOCUMENTS 1,818,418 A * 8/1931 Millard ..... 52/263

(Continued)

FOREIGN PATENT DOCUMENTS

JP 3025069 3/1996

(Continued)

*Primary Examiner*—Brian E Glessner
*Assistant Examiner*—Jason Holloway
(74) *Attorney, Agent, or Firm*—Kenyon & Kenyon LLP

(57) ABSTRACT

The present invention provides construction configurations and a construction method for steel houses that eliminate the shortcoming of the conventional platform construction method for steel houses that complicates the structure because of the need to use metal reinforcements without losing the advantage of the conventional method that facilitates the construction work by using wall panels. After constructing the ground story wall (lower story wall) 22 by attaching wall panels 21 for the ground story to through vertical frame studs 20 extending to upper floors, the second story wall (upper story wall) 23 is constructed by attaching wall panels 21 for the upper Story to the through vertical frame studs 20. Of the wall panels 21 disposed along the four sides of the lower story, the top ends 29 of the two opposite wall panels 21*b* are positioned lower than the top ends 29*a* of the lower story wall panels 21*a* on the other two opposite sides. Both ends of the floor panel 24 are mounted on the lower top ends 29 of the wall panels 21*b*.

4 Claims, 11 Drawing Sheets

U.S. PATENT DOCUMENTS

| | | | | |
|---|---|---|---|---|
| 3,310,926 | A * | 3/1967 | Brandreth et al. | 52/481.1 |
| 3,514,912 | A * | 6/1970 | Smith | 52/205 |
| 3,821,868 | A * | 7/1974 | Edwards | 52/241 |
| 4,514,950 | A * | 5/1985 | Goodson, Jr. | 52/653.1 |
| 5,070,667 | A * | 12/1991 | Schulte | 52/241 |
| 5,113,631 | A * | 5/1992 | diGirolamo et al. | 52/236.8 |
| 5,289,665 | A * | 3/1994 | Higgins | 52/655.1 |
| 5,321,924 | A * | 6/1994 | Smolik | 52/204.1 |
| 5,669,194 | A * | 9/1997 | Colasanto et al. | 52/236.8 |
| 5,867,964 | A * | 2/1999 | Perrin | 52/745.1 |
| 6,185,881 | B1 * | 2/2001 | Olberding et al. | 52/204.1 |
| 6,298,617 | B1 * | 10/2001 | de Quesada | 52/236.3 |
| 6,418,694 | B1 * | 7/2002 | Daudet et al. | 52/650.1 |
| 6,460,297 | B1 * | 10/2002 | Bonds et al. | 52/79.1 |
| 6,625,937 | B1 * | 9/2003 | Parker et al. | 52/79.7 |
| 6,754,999 | B1 * | 6/2004 | Urbanczyk | 52/272 |
| 7,134,246 | B1 * | 11/2006 | Olberding et al. | 52/210 |
| 7,373,762 | B2 * | 5/2008 | Hubbard | 52/281 |
| 7,634,879 | B2 * | 12/2009 | Trotter | 52/204.2 |
| 2004/0049997 | A1 * | 3/2004 | Wheeler | 52/204.2 |
| 2004/0200172 | A1 * | 10/2004 | Beck et al. | 52/506.03 |
| 2005/0279901 | A1 * | 12/2005 | McCoy et al. | 248/300 |

FOREIGN PATENT DOCUMENTS

| | | |
|---|---|---|
| JP | 10-311110 | 11/1998 |
| JP | 11-140975 | 5/1999 |
| JP | 2000-129825 | 5/2000 |
| JP | 2003-147852 | 5/2003 |
| TW | 364035 | 7/1999 |

* cited by examiner

CONSTRUCTION CONFIGURATIONS AND CONSTRUCTION METHODS OF STEEL HOUSES

TECHNICAL FILED

The present invention relates to construction configurations and construction methods of steel houses.

BACKGROUND ART

Steel houses are generally defined as steel panel construction buildings comprising light gage frame members made from sheet steels not less than 0.4 mm and less than 2.3 mm in thickness and structural face members combined with said frame members. When building relatively low buildings, such as of two or three stories, with such steel members, building has conventionally been carried out by the platform construction method (the so-called frame-wall construction method) that completes one story after another by first completing the ground story by laying the floor thereof and placing the wall panels for one story and then mounting the floor panel of the upper story on the wall panels of the ground story, thus completing one story after another. This platform construction method has an advantage of eliminating the need for heavy machines and scaffolds.

On the other hand, the platform construction method joins the wall panels of the upper and lower stories by using hold-down hardware (sometimes referred to as HD hardware) and long bolts and provides metal reinforcements to transfer the compressive force working on the floor panel joists whose ends are inserted between the wall panels of the upper and lower stories. The need to provide such hold-down hardware and metal reinforcements complicates the structure of buildings.

The design method for steel houses built by the platform construction method is explained by reference to schematic drawings in FIG. 10.

As shown in FIG. 10, the platform construction method first completes the floor of the ground story (not shown) and builds the walls 2 of the ground story by mounting the wall panels 1 for one story thereon. After the completion of the walls 2 of the ground story, the floor panel 3 for the upper story is mounted and, then, the walls 4 of the second story are constructed by mounting the wall panels 1 for one story on said floor panel 3. The wall panel 1 comprises a rectangular wall frame consisting of vertical frame members and top and bottom horizontal frame members and a structural face plate attached thereto. The floor panel 3 consists of a floor plate attached to side and end joists.

In a steel house built, as described above, by the platform construction method, the walls 2 and 4 of the upper and lower stories are joined together by hold-down hardware 5 and other connection hardware by way of the floor 3*a*. Japanese Unexamined Patent Publication No. 10-311110 discloses an example of the joined construction described above, as shown in FIG. 11.

In FIG. 11, a wall panel 1 for the upper and lower stories comprises a wall frame consisting of vertical frame members 10 and a top and a bottom horizontal frame members 11 and 12, all made of light-gage channels of sheet steels, and a structural face plate 13 (hereinafter referred to as the face plate) attached to said frame members. In the upper part of the wall panel 1, as shown in FIG. 11, the vertical frame members 10 and top horizontal frame member 11 are fastened together by the hold-down hardware 5. In the lower part of the wall panel 1, as shown in FIG. 11, the vertical frame members 10 and bottom horizontal frame member 12 are fastened together by the hold-down hardware 5.

The floor panel 3 comprising a floor plate 17 mounted on side and end joists of light-gage channels of sheet steels is disposed between the upper end of the wall panel 1 of the lower story and the lower end of the wall panel 1 of the upper story as a partition therebetween. Connection hardware 8 is attached to the floor panel 3. The connection hardware 8 comprises a cylindrical bolt holder 6 and horizontal flanges 7 fastened at the top and bottom ends thereof, said top and bottom flanges 7 having a bolt insertion hole 7*a*. The upper and lower wall panels 1 are joined together by connecting a bolt 14 passed through the bolt holder 6 of the connection hardware to the hold-down hardware 5 attached to the wall panels 1 of the upper and lower stories. The connection hardware 8 is vertically mounted so as to contact the top and bottom ends of the joists 15 and 16, whereas the bolt 14 is passed along the hold-down hardware 5 of the lower story and through the bolt holder 6 of the connection hardware 8 and the floor plate 17 and the bottom frame member 12 of the wall frame of the upper story, and then fastened by a nut 18 to the hold-down hardware 5 of the upper story. The lower end of the bolt 14 is similarly fastened by a nut 18 to the hold-down hardware 5 of the lower story. Thus, the hold-down hardware 5 joins the wall panels 1 of the upper and lower stories by way of the floor panel 3.

The platform construction method just described requires intricate design that, in turn, makes field work difficult because connection of the wall panel 1 to the floor panel 3 and that of the wall panels 1 of the upper and lower stories require hold-down hardware 5, connection hardware 8 and other metal reinforcements. If such metal reinforcements are eliminated or reduced in order to avoid an increase in the number of structural members and complicated design, construction becomes hazardous. Furthermore, the conventional platform construction method tends to require intricate design because load transfer paths are complicated.

Japanese Unexamined Patent Publication No. 11-140975 discloses a method for improving the platform construction method requiring hold-down hardware. This improving method provides multiple vertical frame studs constituting a wall surface frame that are expanded throughout the whole stories and hold a floor panel and a wall panel surface member fastened thereto, laterally and vertically.

However, the technology disclosed in Japanese Unexamined Patent Publication No. 11-140975 defies a simple method practicable with the platform construction method in which unitized wall panels, which are prepared by fastening a structural surface member to a rectangular wall frame, are joined together, one story after another. The technology disclosed in Japanese Unexamined Patent Publication No. 11-140975 involves a problem that the time and the trouble in field work increase because wall panel surface members must be attached at the construction site after all vertical frame studs extending to the uppermost story have been joined together.

DISCLOSURE OF THE INVENTION

First, the present invention provides a steel house frame construction that eliminates a shortcoming, with the conventional platform construction method, that the use of hold-down and other reinforcing hardware results in a complicated construction. At the same time, the present invention exploits an advantage of the conventional platform construction method that eliminates the need for heavy machines and scaffolds by completing walls one story after another. Second, the present invention eliminates another shortcoming with the construction method described in Japanese Unexamined Patent Publication No. 11-140975 that does not require hold-down and other hardwares and, therefore, permits a simple construction. The conventional method described earlier has a shortcoming that the time and the trouble in field work increases because structural face members (wall members) are attached on site after vertical frame studs extending to the uppermost story have been constructed. The present invention reduces the need for this field work.

In order to achieve the aforementioned objects, the present invention consists of:

First, a steel house construction configuration made by constructing a structural framework by assembling vertical frame studs and wall panels erected on a foundation and a floor panel, in which the vertical frame studs provided at intersections of the wall panels and corners are through studs continuing to upper stories, the wall panels are prepared by attaching a face member to a wall frame preparing by assembling light gage channels made from sheet steel into a rectangular form, and the walls of an upper story are constructed by connecting the wall panels for the upper story after the walls of a lower story have been constructed by connecting the wall panels for the lower story to said through vertical frame studs.

Second, the steel house construction configuration according to the first invention in which girder walls and party walls are constructed by placing said through vertical frame studs in the thickness of the wall panels by forming the vertical frame studs into a rectangular cross section and joining the wall panels to all sides of the rectangle by means of fasteners.

Third, the steel house construction configuration according to the first or second invention in which the wall panels to be attached to the through vertical frame studs are disposed along the four sides of a rectangle that constitutes a room, the upper edges of the wall panels of the lower story on two opposite sides are positioned lower than the upper edges of the wall panels of the lower story on the other two opposite sides, and two opposite sides of a floor panel formed by attaching a floor plate to floor joists are supported on the upper end of the two lower wall panels on two opposite sides.

Fourth, the steel house construction configuration according to the first to third inventions in which the through vertical frame studs are made of steel sections, wood or steel-reinforced concrete.

Fifth, the steel house construction configuration according to the first to fourth inventions, in which the vertical frame studs and wall panels are joined by using fasteners such as drill screws, bolts and one-side bolts.

Sixth, the construction of the steel house according to the first to fifth inventions, the panel structure is constructed by erecting through vertical studs continuing to an upper story on the ground, placing wall panels four sides of a rectangle constituting a room on a lower story and connected to the through vertical frame studs, mounting two opposite sides of a floor panel for an upper story on the upper ends of the wall panels on the two opposite sides of a lower story, connecting the other two opposite sides of the floor panel to through vertical frame studs, and constructing the walls and floors of upper stories by repeating said procedure.

BRIEF DESCRIPTION OF THE DRAWINGS

FIG. 5(*b*) is a detail view of a floor panel supporting structure.

FIG. 7(*b*) is a vertical cross-sectional view of a wall panel.

FIG. 8(*b*) is an explanatory plan view illustrating a step to attach wall panels to a through vertical frame stud.

FIG. 10(*b*) is a detail view of part C in FIG. 10(*a*).

FIG. 11(*b*) is an exploded perspective view of metal connectors.

BEST MODE FOR PRACTICING THE INVENTION

Figure 5B:
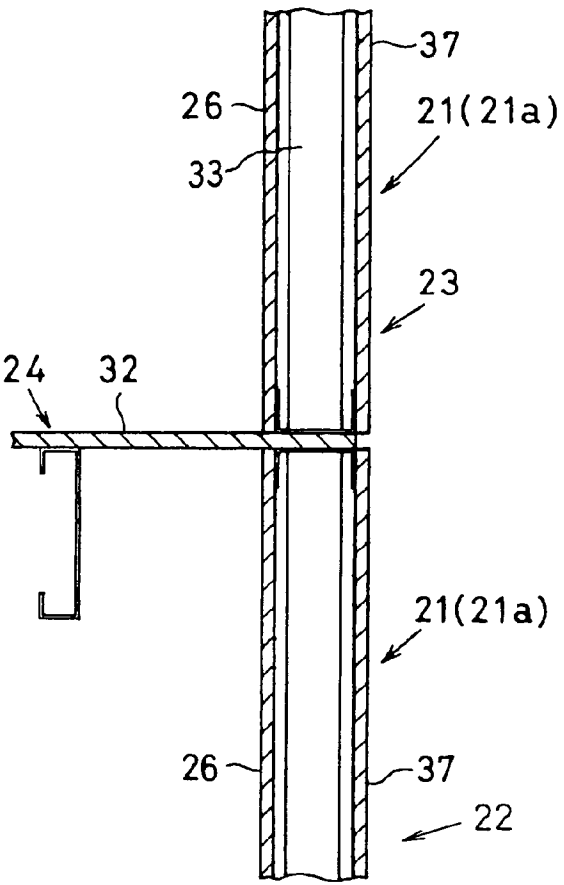
FIG. 5(*a*) is a detail view of a floor panel supporting structure.
Figure 5A:
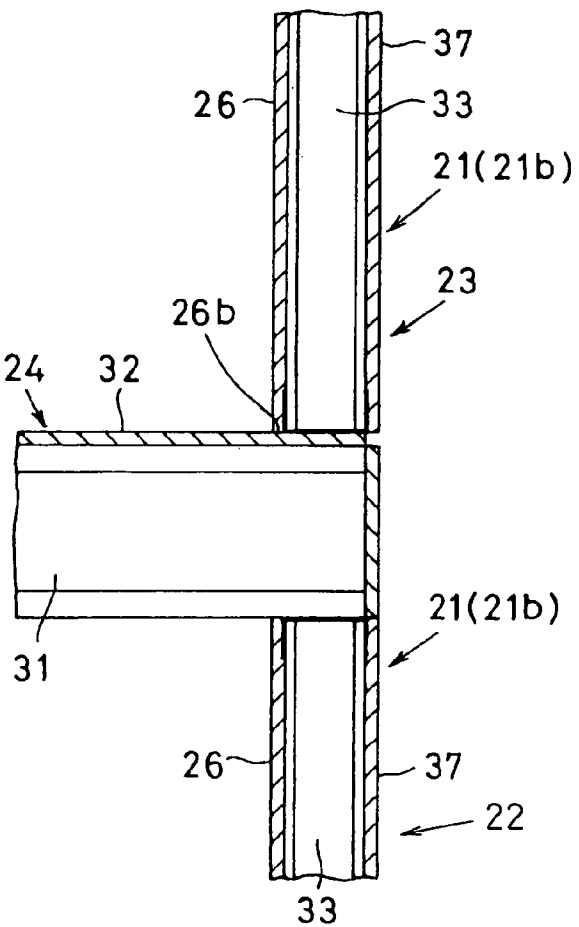
Figure 6:
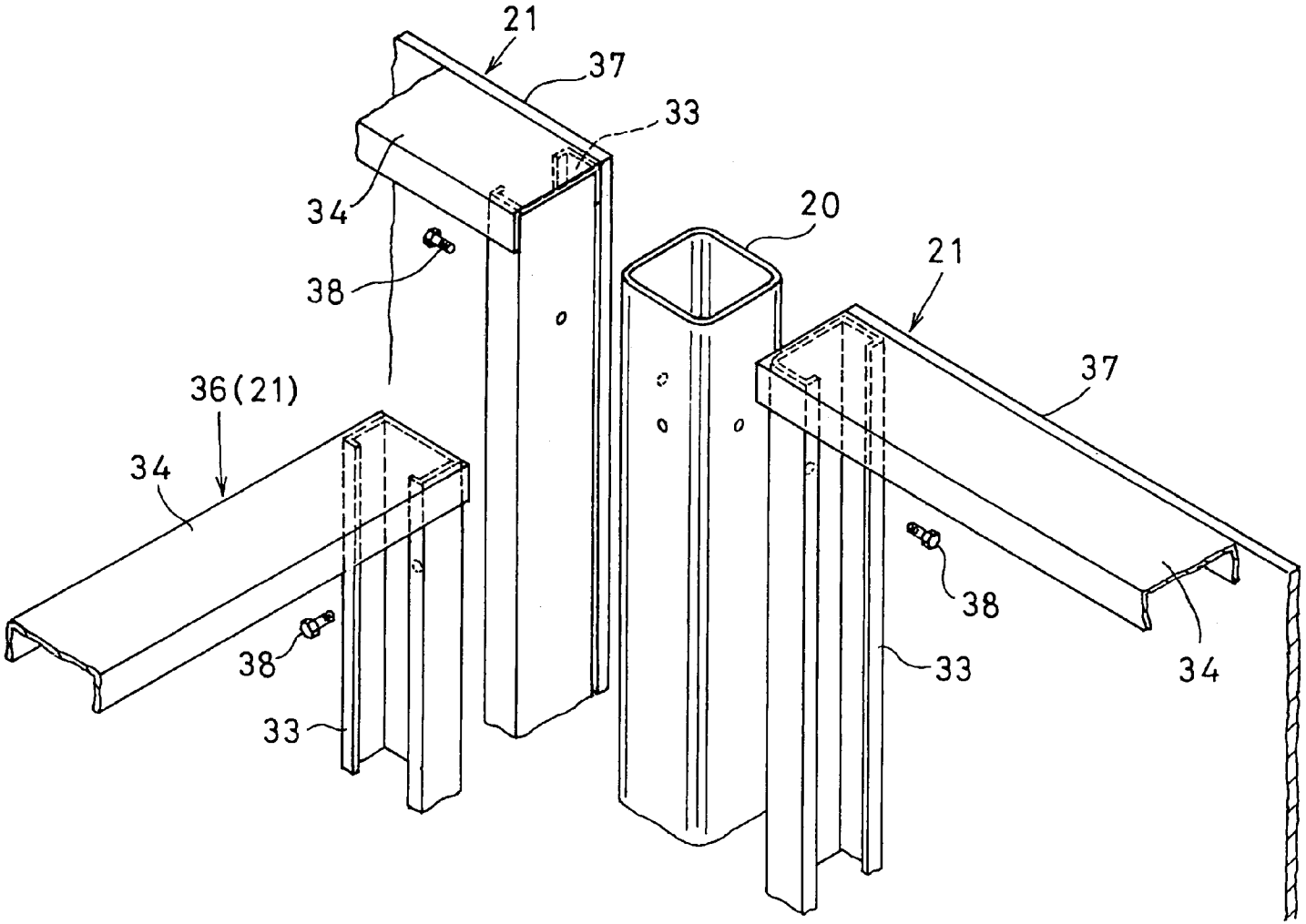
FIG. 6 is a perspective view showing wall panels being attached to a through vertical frame stud.
Figures 7A, 7B:
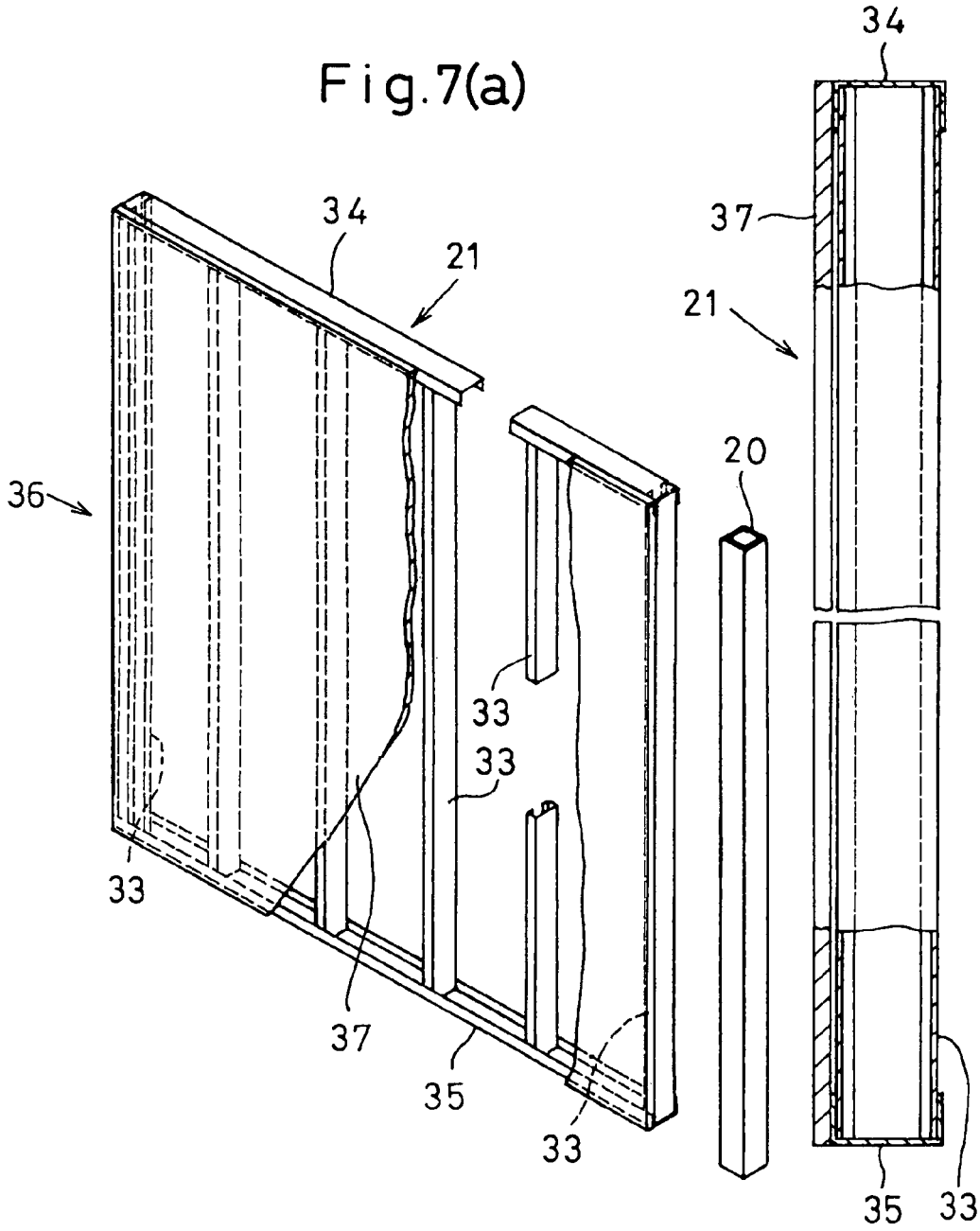
FIG. 7(*a*) is a perspective view of a wall panel.
Figure 8B:
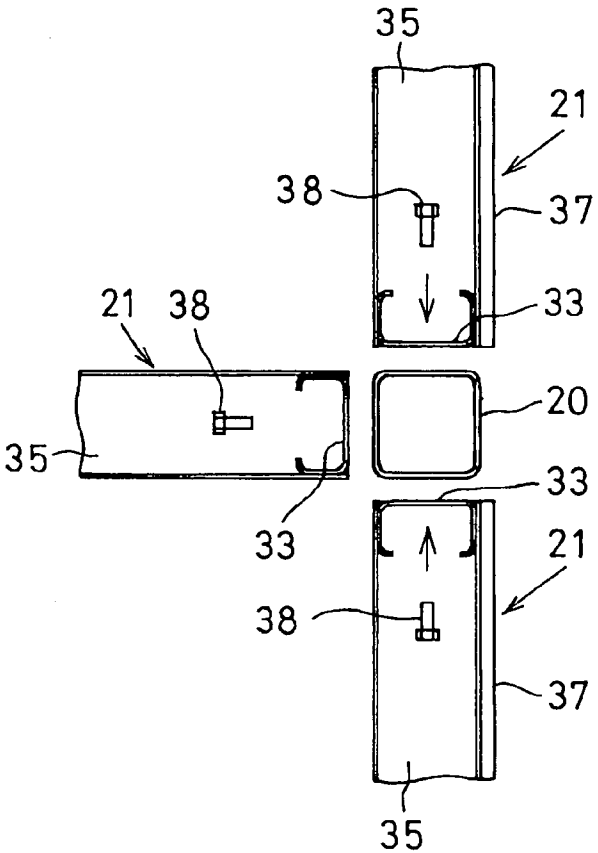
FIG. 8(*a*) is an explanatory plan view illustrating a step to attach wall panels to a through vertical frame stud.
Figure 8A:
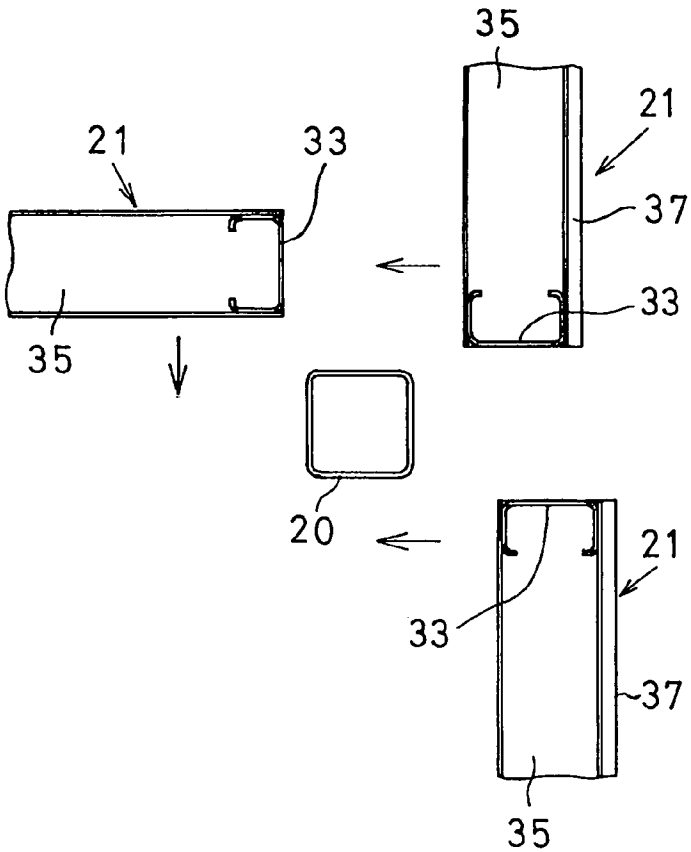
Figure 9:
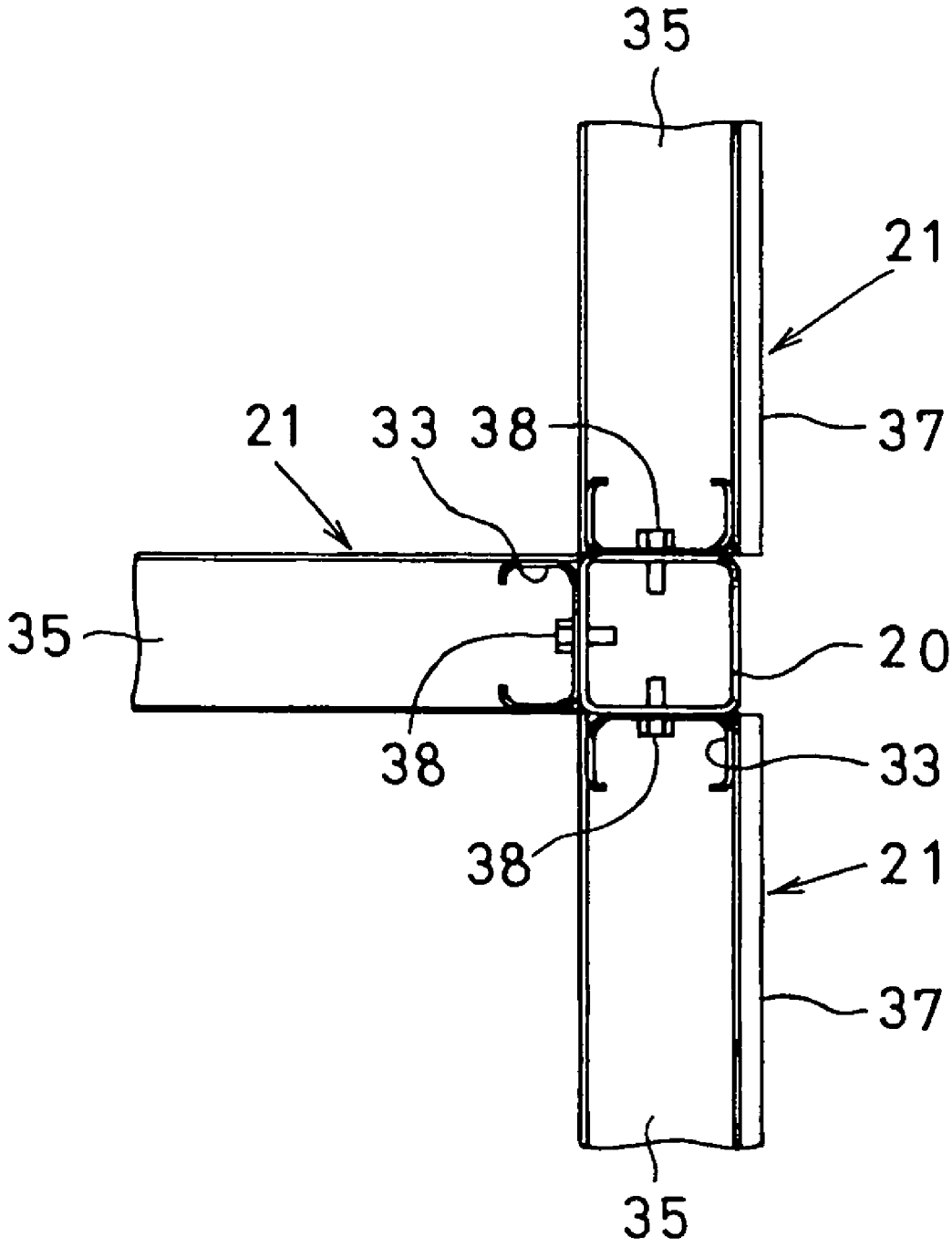
FIG. 9 is an explanatory plan view illustrating a step to attach wall panels to a through vertical frame stud.
Figure 10B:
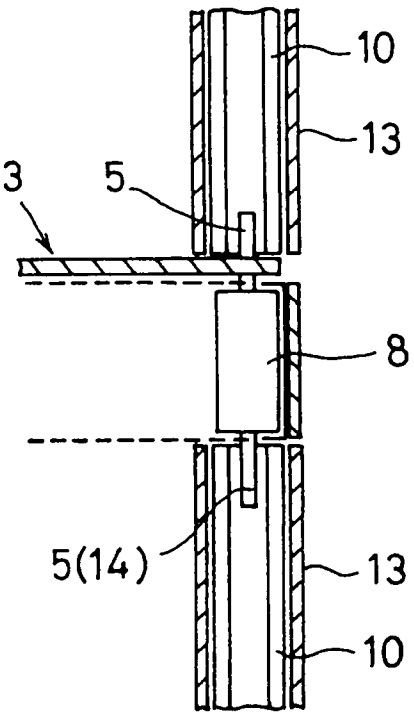
Fig.10(b) PRIOR ART
FIG. 10(*a*) is a schematic view illustrating a design method for a steel house according to the conventional platform construction method.
Figure 10A:
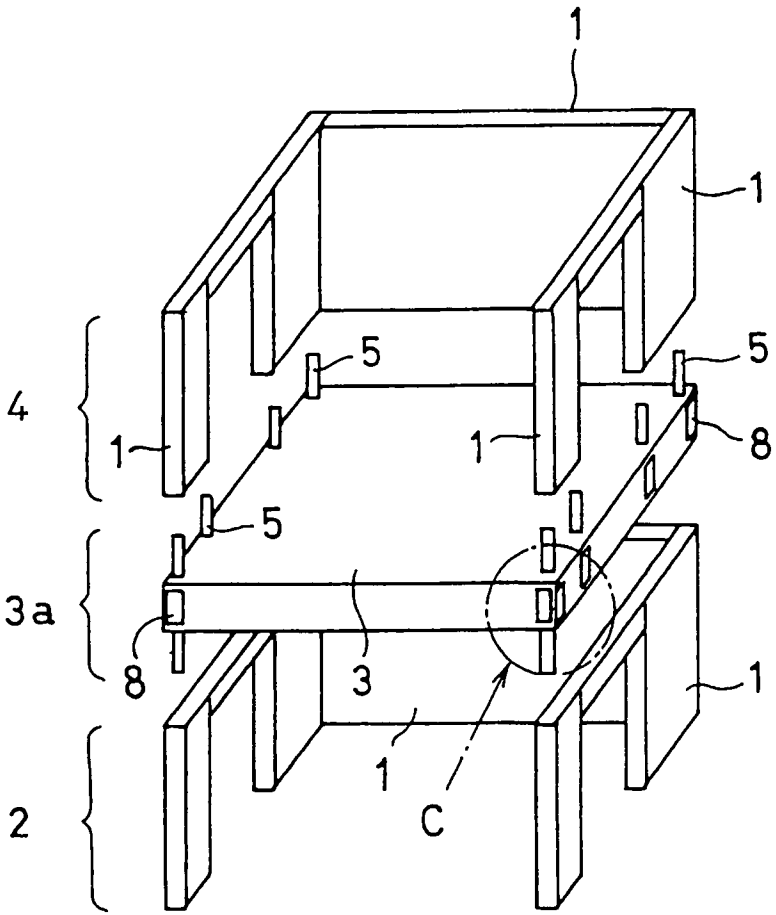
Fig.10(a) PRIOR ART
Figure 11A:
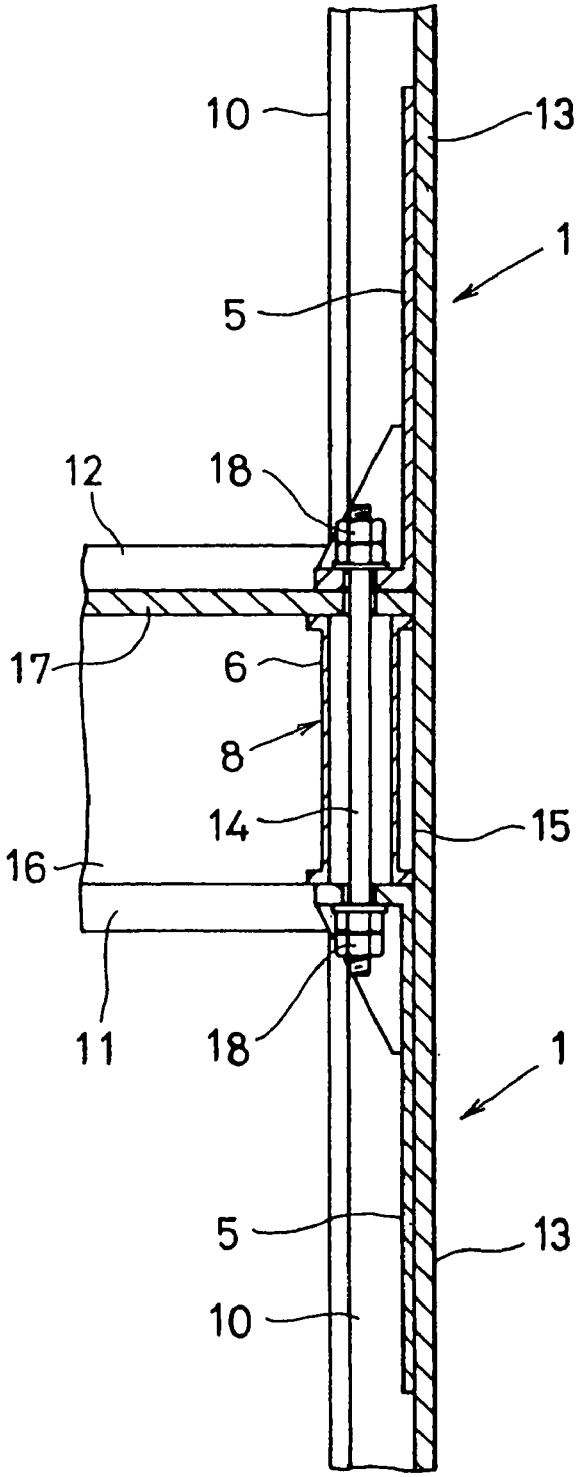
Fig.11(a) PRIOR ART
FIG. 11(*a*) is an explanatory side elevation illustrating how upper and lower stories are joined together by the conventional platform construction method.
Figure 11B:
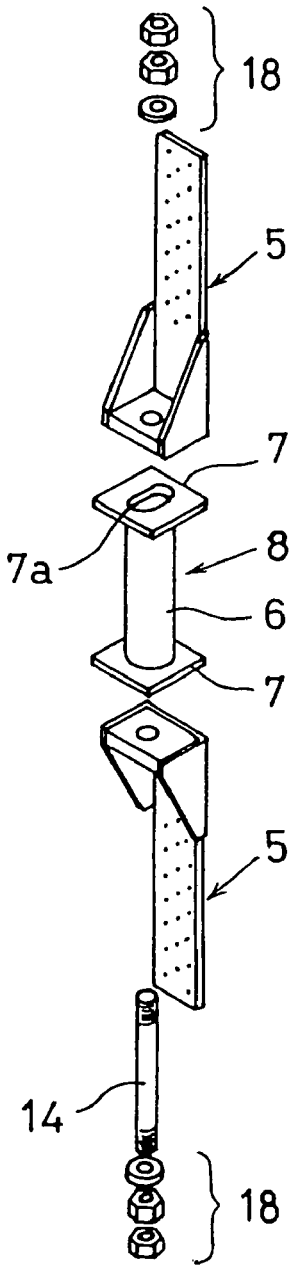
Fig.11(b) PRIOR ART

FIGS. 1 to 4 are schematic views illustrating steps for constructing a structural framework of a steel house in an embodiment according to the present invention. FIGS. 5(*a*) and 5(*b*) are detail views of a floor panel support structure. FIG. 6 is a perspective view showing wall panels being attached to a through vertical frame stud. FIG. 7(*a*) and 7(*b*) are perspective and vertical cross-sectional views of a wall panel. FIGS. 8(*a*), 8(*b*) and 9 are explanatory plan views illustrating steps to attach wall panels to through vertical frame studs.

Figure 1:
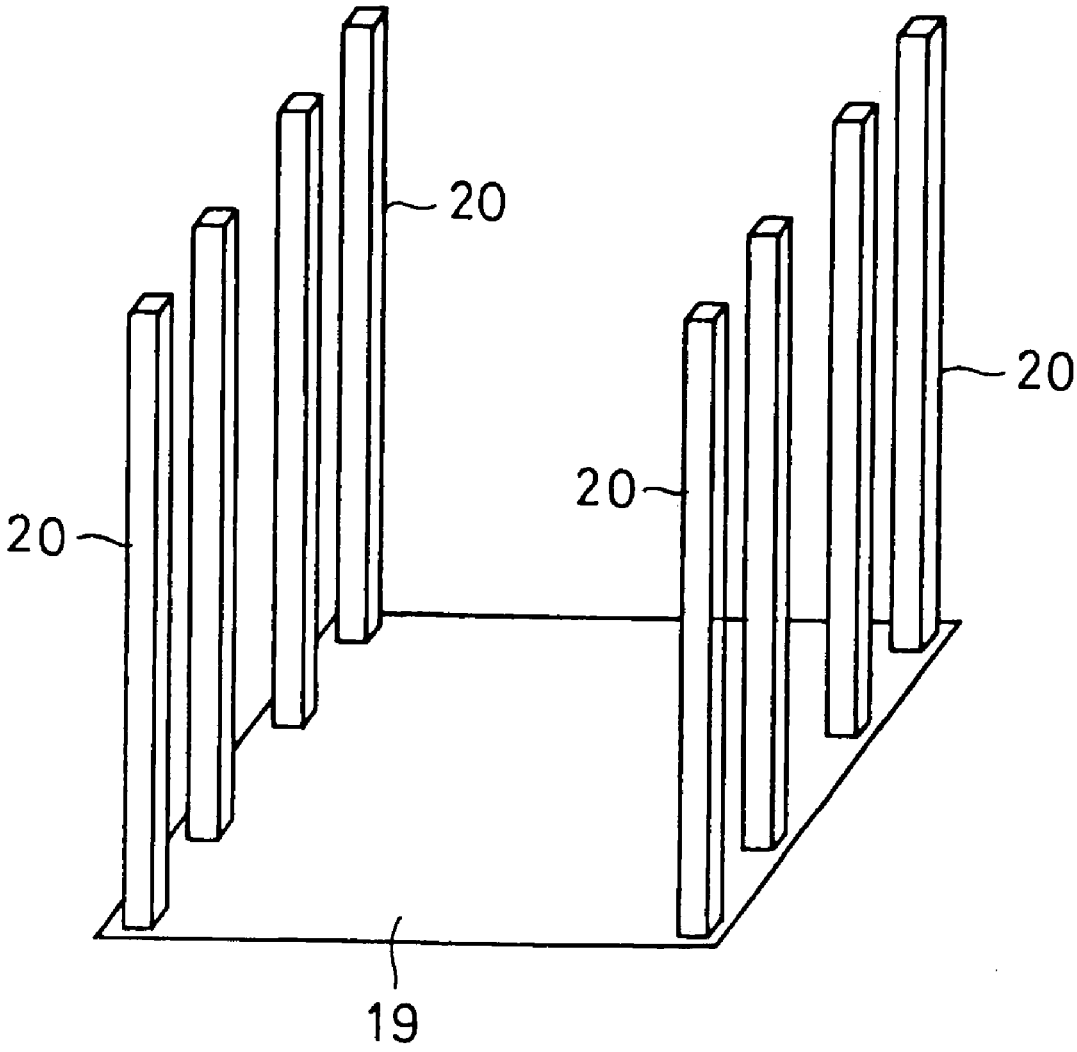
FIG. 1 is a schematic view showing the first construction step of a structural framework of a steel house according to the present invention.
Figure 2:
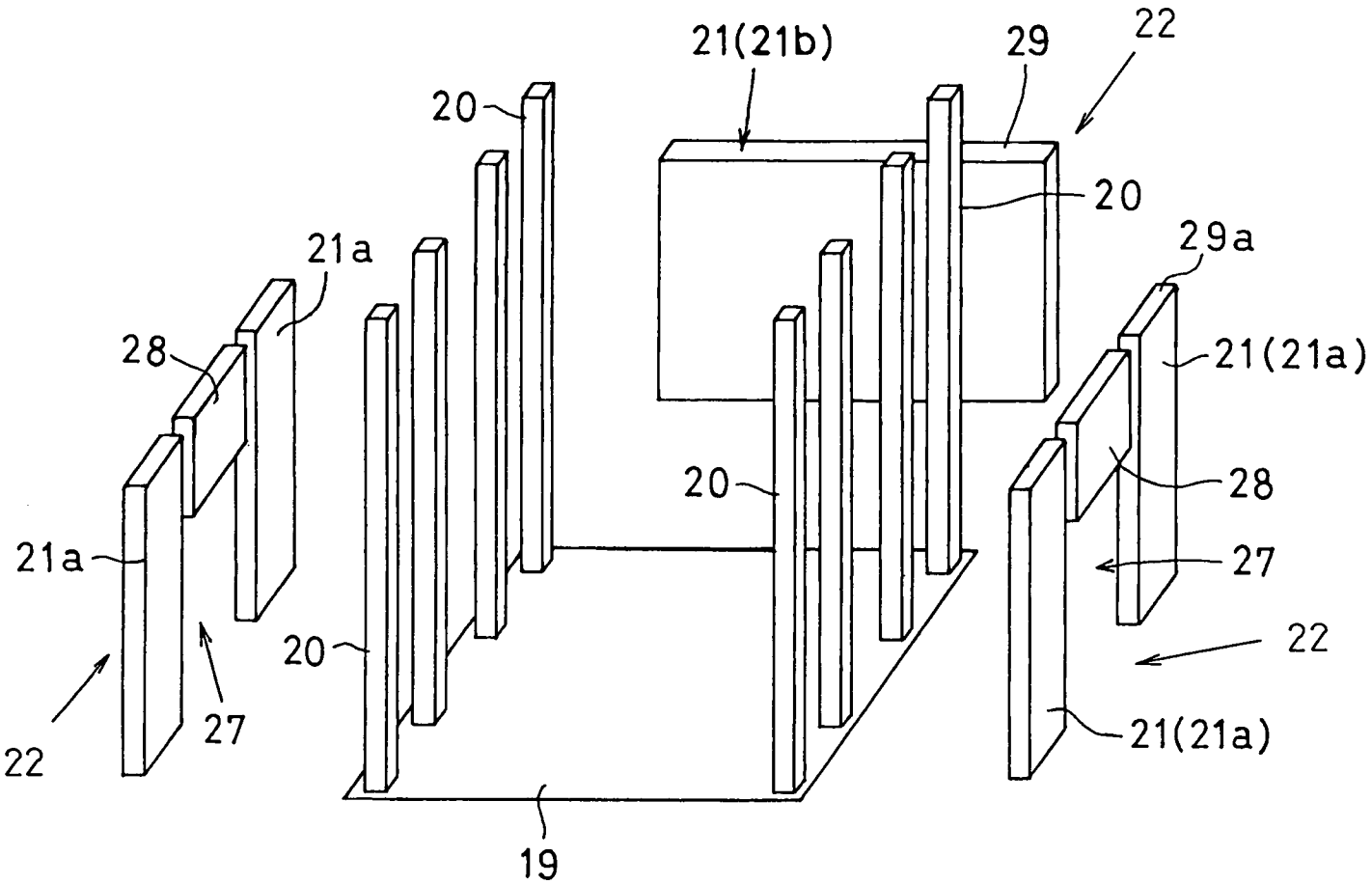
FIG. 2 is a schematic view showing the second construction step of the structural framework of the steel house according to the present invention.
Figure 3:
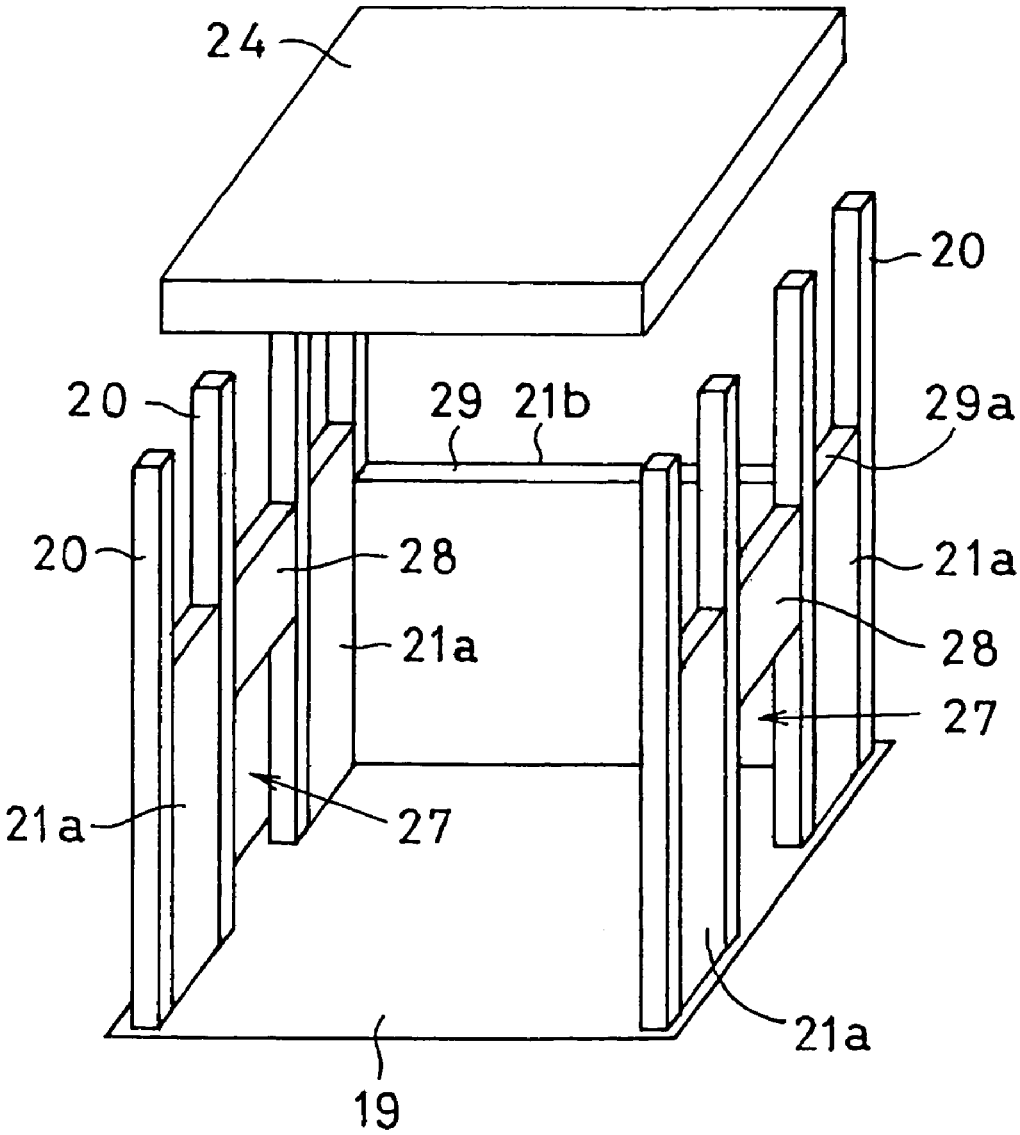
FIG. 3 is a schematic view showing the third construction step of the structural framework of the steel house according to the present invention.
Figure 4:
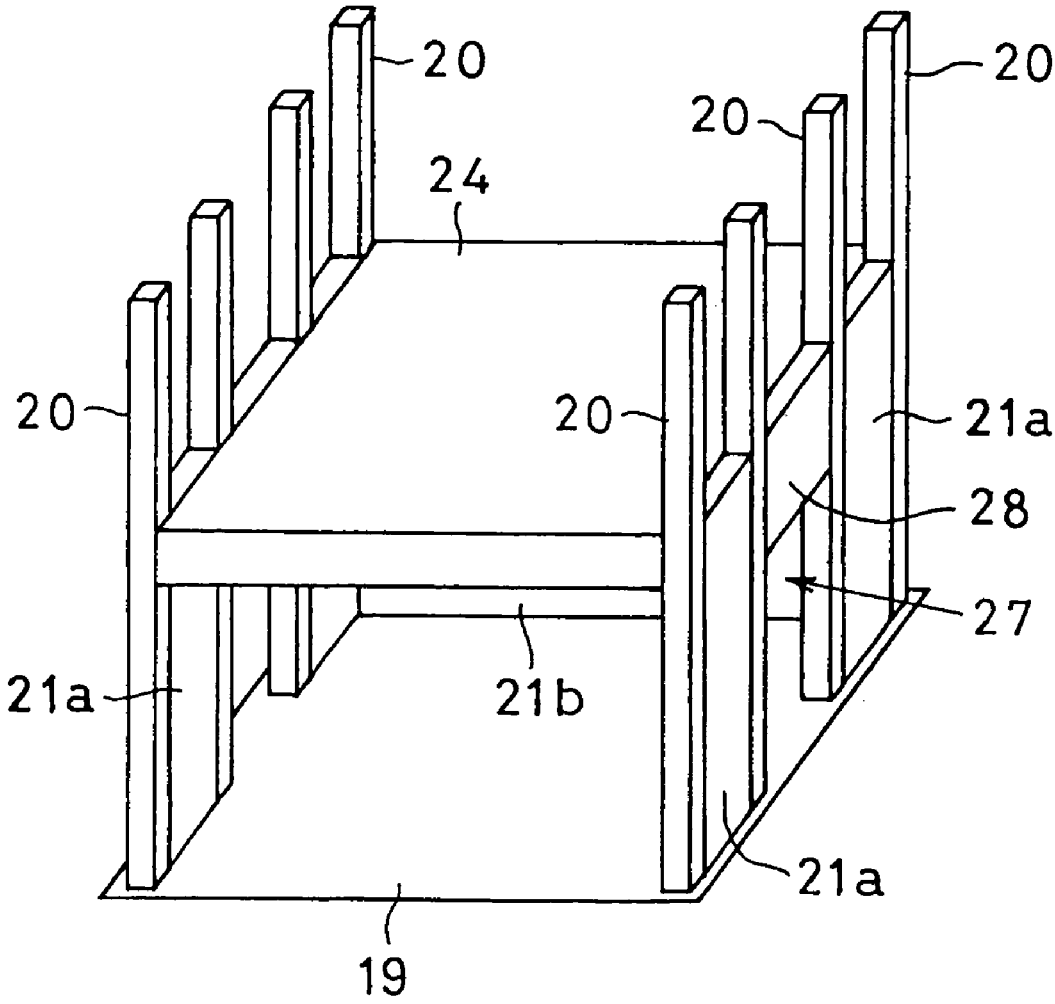
FIG. 4 is a schematic view showing the fourth construction step of the structural framework of the steel house according to the present invention.

A brief description of the present invention is given by reference to schematic views in FIGS. 1 to 4. According to the steel house panel construction according to the present invention, the floor 19 of the ground story is completed first and, then, multiple through vertical frame studs 20 are erected thereon along and, at given intervals, the four sides of a rectangle (FIG. 1). Next, the ground story wall 22 is completed by attaching wall panels 21 for one story, from outside, to the vertical studs 20 disposed along the four sides of the rectangle (FIG. 2). Wall panels 21*a* and a lintel panel 28 thereabove form a doorway opening 27 in the ground story wall 22 on two opposite sides, as shown in FIG. 2. The upper end of the wall panel 21*b* on the two opposite sides are lower than the upper end of the wall panel 21*a* on the other two opposite sides, as shown in FIGS. 2 and 3. Next, both ends of a floor panel 24 are mounted on the upper ends of the lower wall panels 21*b* on the two opposite sides (as shown in FIG. 5(*a*)).

The floor panel 24 is prepared by attaching a floor plate 32 to the top surface of floor joists (side and end joists) of light gage shapes made from sheet steel. Both ends of the floor panel 24 are connected to the upper ends of the wall panels 21 *a* on the other two opposite sides that constitute the second story wall, as in the case of the ground story wall 22 (as shown in FIG. 5(*b*)). The ends of the floor joists 31 of the floor panel 24 may also be fastened to the wall frame 36 by way of angles or other horizontal support frames (not shown).

The wall panels 21 disposed along the four sides of a rectangle to form each story are attached to the through vertical frame studs 20, with the lower ends of all wall panels 21 are flush on all sides. Therefore, the upper and lower ends of the wall panels 21*a* of the upper and lower stories on two opposite sides are directly butt-connected. The ends of the wall panels 21*a* are connected by using appropriate metal connectors. The lower ends of the wall panels 21*b* of the upper story on the other two opposite sides hold the top surface of the both ends of the floor panel 24, as shown in FIG. 5(*a*).

According to the present invention, the ground story wall (the wall of a lower story) 22 is completed first by attaching the wall panels 21 to the through vertical frame studs 20 extending to the upper story, and then the second story (the wall of an upper story) is built by repeating the process described above. By permitting construction of structural frameworks, including walls, of individual stories from lower ones to upper ones, the method of the present invention has the same advantage, that heavy machines and scaffolds are unnecessary, as the conventional platform construction method. Besides, the method of the present invention does not need the hold-down hardware and metal connectors required by the conventional platform construction method that connects the wall panels of the upper and lower stories by way of floor panels, thus streamlining the details of structural frameworks and eliminating the shortcoming of the conventional platform construction method. The floor panel 24 may also be supported by methods other than placing both ends thereof on the upper ends of the wall panels 21*b* of the lower story.

Concrete structures of the wall panel 21 and the connection between the through vertical frame studs 20 and wall panels 21 are described by reference to FIG. 6 to 9. The wall panel 21 is prepared by fastening a structural face member (an outer wall face member) 37 to the outside of a wall frame 36 prepared by assembling vertical frames 33, a top frame 34 and a bottom frame 35 of light-gage shapes of sheet steel into a rectangular form, as shown in FIGS. 6 and 7. The wall panels 21 are shop-prefabricated and the walls of individual stories are constructed by fastening the wall panels 21 to the sides of the through vertical frame studs 20 from two or three directions, as shown in FIG. 6 and on. The face member 26 for the inner wall shown in FIG. 5 is formed by attaching a wall panel 21 to through vertical frame studs 20 and, then, is fastened to the inside of a wall frame 36 at the worksite.

In attaching wall panels 21 to a through vertical frame stud 20 of a square cross section, wall panels 21 constituting two girder walls and a wall frame of a wall panel 21 constituting a party wall (at this stage, the face member is not yet fastened to the wall frame 36 of the party wall) are brought close to three sides of the through vertical frame stud 20 from the three directions indicated by arrows in Fig. 8(*a*). Then, the back face of a vertical frame 33, which is a light-gage steel section made from sheet steel, for the wall frame 36 is put against a side of the through vertical frame stud 20, and the wall panel 21 is fastened to the through vertical frame stud 20 by driving a drill screw, a one-side bolt or other fastener 38 through the faces thereof held in contact. The thickness of the wall panel 21 constituting the wall frame 36 is not greater than the width of each side of the through vertical frame studs 20 that are erected at intervals. Therefore, the through vertical frame studs 20 are within the thickness of the wall frame 36 of each wall panel 21 and do not protrude from the side of the wall panel 21.

The present invention (1) streamlines details of the structural framework, eliminates the need for metal reinforcements, reduces work loads at jobsites and simplifies designs because walls of individual stories are constructed by attaching wall panels 21 of upper and lower stories to through vertical frame studs 20 extending to upper stories, and (2) achieves the improvement described in (1) above while maintaining the advantage of the conventional platform construction method by supporting both ends of the floor panel 24 on the upper ends of the wall panels 21 on two opposite sides.

INDUSTRIAL APPLICABILITY

The present invention has the following advantages: (1) the present invention provides greater working efficiency than conventional technologies because vertical frame studs at intersections of wall panels or corners are extended to continue to upper stories and shop-prefabricated wall panels are connected thereto, from lower to upper stories. That is to say, the present invention dispenses with the troublesome task of attaching, at jobsites, structural face members to the wall frames, consisting of pre-erected through vertical frame studs, involved in the conventional construction method. (2) The present invention reduces jobsite work-loads and simplifies design by streamlining the details of structural frameworks and eliminating the need for hold-down hardware and other complex metal reinforcements. (3) The present invention achieves the improvement described in (2) above while maintaining the advantage of the conventional platform construction method that does not need heavy machines and scaffolds because individual stories can be built from below after erecting through vertical frame studs.

The invention claimed is:

1. A steel house construction configuration, made by constructing a structural framework by assembling vertical frame studs and wall panels prepared by attaching a face member to a wall frame prepared by assembling light gauge channels made from sheet steel into rectangle form erected on a foundation and a floor panel formed by attaching a floor plate to floor joists, characterized in that the walls of an upper story are constructed in the manner that the vertical frame studs provided at intersections of the wall panels and corners are through studs continuing to an upper story, the wall panels for the lower story are disposed along the four sides of a rectangle that constitutes a room of the lower story and connected to the through studs;

the upper edges of the wall panels of the lower story on two opposite sides are positioned lower than the upper edges of the wall panels of the lower story on the other two opposite sides the wall panels and a lintel panel therebetween form a doorway opening in the wall of the lower story in at least one of the other two opposite sides, and the floor panel and the wall panels of the upper story are supported on the upper end of the wall panels of the lower story on the two opposite sides and the wall panels of the upper story are connected to the upper end of the wall panels of the lower story on the other two opposite sides while putting the floor plate therebetween.

2. The steel house construction configuration according to claim 1, in which girder walls and party walls are constructed by placing said through vertical frame studs in the thickness of the wall panels by forming the vertical frame studs into a rectangular cross section and joining the wall panels to all sides of the rectangle by means of fasteners.

3. The steel house construction configuration according to claim 1 wherein the through vertical frame studs are made of steel sections, wood or steel reinforced concrete.

4. The steel house construction configuration according to claim 2 wherein the vertical frame studs and wall panels are joined by using fasteners selected from drill screws, bolts and one-side bolts.

* * * * *